US005439303A

United States Patent [19]

Alday

[11] Patent Number: 5,439,303

[45] Date of Patent: Aug. 8, 1995

[54] SPLIT-SPLINE HUB AND LATCH MECHANISM

[75] Inventor: James M. Alday, Honeoye Falls, N.Y.

[73] Assignee: Xerox Corporation, Stamford, Conn.

[21] Appl. No.: 139,773

[22] Filed: Oct. 22, 1993

[51] Int. Cl.[6] ..... B41J 32/00; B65H 75/00

[52] U.S. Cl. ..... 400/242; 400/246; 400/236; 242/597.2; 242/611.2

[58] Field of Search ..... 400/236, 236.1, 236.2, 400/242, 246, 208; 242/342, 571, 571.3, 571.4, 597.1, 597.2, 597.3, 597.5, 597.6, 611, 611.2, 613, 613.1, 613.2, 613.3, 613.4

[56] References Cited

U.S. PATENT DOCUMENTS

| | | | |
|---|---|---|---|
| 2,889,123 | 6/1959 | Hayden | 242/597.3 |
| 3,312,410 | 4/1967 | Strothmann | 242/611.2 |
| 3,347,485 | 10/1967 | Bundschuh | 242/597.3 |
| 3,417,939 | 12/1968 | Bunting | 242/597.3 |
| 4,083,516 | 4/1978 | Schuch et al. | 242/597.3 |
| 4,476,496 | 10/1984 | Thaler | 358/286 |
| 4,756,635 | 7/1988 | Frerichs | 400/236 |
| 4,823,195 | 4/1989 | Ito | 358/285 |
| 4,917,515 | 4/1990 | Piller et al. | 400/208 |
| 4,920,421 | 4/1990 | Stemmle | 358/296 |
| 5,032,922 | 7/1991 | Stemmle | 358/296 |
| 5,040,074 | 8/1991 | Stemmle | 358/296 |
| 5,049,999 | 9/1991 | Stemmle | 358/296 |
| 5,077,614 | 12/1991 | Stemmle et al. | 358/296 |
| 5,153,736 | 10/1992 | Stemmle | 358/296 |
| 5,162,916 | 11/1992 | Stemmle et al. | 358/296 |
| 5,187,588 | 2/1993 | Stemmle | 358/296 |

FOREIGN PATENT DOCUMENTS

| | | | |
|---|---|---|---|
| 3725561 | 2/1988 | Germany | 400/242 |
| 61-205170 | 9/1986 | Japan | 400/236 |

*Primary Examiner*—David A. Wiecking
*Attorney, Agent, or Firm*—Oliff & Berridge

[57] ABSTRACT

A ribbon cartridge includes two hubs, each hub having two sets of longitudinally extending splines. The two sets are offset from each other circumferentially and longitudinally and form a detent between the sets. A latch mechanism includes a retaining member fixed to a mandrel assembly, the retaining member including first and second pairs of elastic locking members having raised surfaces. The raised surfaces of one of the pairs of locking members engage the detent formed between the first and second sets of hub splines, and the raised surfaces of the other pair of locking members engage a spindle of the mandrel assembly, effectively securing the ribbon cartridge to the mandrel assembly.

36 Claims, 10 Drawing Sheets

SPLIT-SPLINE HUB AND LATCH MECHANISM

CROSS REFERENCE TO RELATED APPLICATIONS

This application is related to the following applications, all filed concurrently with this application and commonly assigned to the assignee of this application:

1) U.S. patent application No. 08/139,776, entitled "Portable Copier and Method of Using a Portable Copier", by Denis J. Stemmle and Egon Babler;
2) U.S. patent application No. 08/139,783, entitled "Ribbon Cartridge", by Egon Babler and Denis J. Stemmle; and
3) U.S. patent application No. 08/139,786, entitled "Pivoting Platen for Use in Printing Device", by Denis J. Stemmle.

The disclosures of these applications are incorporated herein by reference.

BACKGROUND OF THE INVENTION

1. Field of the Invention

The invention relates to cartridges containing wound lengths of material such as, for example, ribbon cartridges, and more particularly to ribbon cartridge hubs and to latch mechanisms for retaining such cartridges on thermal or impact printing devices such as printers, typewriters, copiers, and facsimile machines, and in particular on portable printing devices.

2. Description of Related Art

In one type of thermal printing technology, a thermal printhead presses a donor film ribbon, housed in a ribbon cartridge, onto the surface of a copy sheet. When the ribbon cartridge is expended, it can be removed from the printing device and replaced by a substitute ribbon cartridge. Because the ribbon capacity of such ribbon cartridges is relatively low, replacing the cartridges is necessary frequently.

Conventional designs, used in typewriters and printers, require an operator to actuate a lever-based latch to disengage the spent ribbon cartridge from its support. After removing the spent ribbon cartridge and installing a new ribbon cartridge on the support, the operator must re-actuate the lever-based latch to secure the new cartridge onto the support. Such designs require a good degree of manual dexterity and are susceptible to damage from improper use.

An alternative design uses spring-loaded latching features on the end of a mandrel over which the hubs of the ribbon cartridge is inserted. An operator must maintain fairly accurate alignment between the cartridge and two mandrels, while pushing the cartridge with sufficient force to overcome the latching force created by the latching features. This design also requires high manual dexterity to operate correctly and is also susceptible to damage from improper use.

A need has arisen, therefore, for a ribbon cartridge and latch mechanism allowing an operator to more simply remove and replace a ribbon cartridge and providing a more robust design, less susceptible to damage from improper use.

SUMMARY OF THE INVENTION

To overcome these and other disadvantages of the prior art, a tubular, hollow hub according to the invention supports a length of material, for example, printing ribbon wound around the hub. The hub includes an outer surface for receiving the material, an inner surface disposed radially inwardly from the outer surface, first and second opposite ends, and a set of splines on the inner surface. The set of splines extends in a longitudinal direction of the hub from near the first end of the hub toward a central portion of the hub; and terminates at the central portion of the hub.

The set of splines is preferably a first set of splines, and the hub preferably includes a second set of splines on the inner surface, extending in the longitudinal direction of the hub from near the second end of the hub toward the central portion of the hub and terminating at the central portion of the hub. The first and second sets of splines are preferably offset from each other, and form a detent extending around at least a portion of an inner circumference of the inner surface at the central portion.

According to another aspect of the invention, a ribbon cartridge for use with a printing device includes a casing and first and second hollow hubs rotatably mounted to the casing. The first and second hubs each include an outer surface, an internal surface, first and second opposite ends, and a set of splines on the internal surface, the set of splines extending in a longitudinal direction of the hub from near the first end of the hub toward a central portion of the hub, the set of splines terminating at said central portion of the hub. A transfer ribbon, preferably containing transferable ink on one surface thereof, is wound between and around the outer surfaces of the first and second hubs.

The set of splines on each hub is preferably a first set of splines, extending from near the first end of the first and second hubs and terminating at the central portion of the first and second hubs. The hubs preferably each include a second set of splines, extending from near the second end of the first and second hubs and also terminating at the central portion of the first and second hubs. The first set of splines is preferably offset from the second set of splines, and the first and second sets of splines form a detent extending around at least portions of an internal circumference of the first and second hubs at their central portions.

Alternatively, the detent can be separate from the set or sets of splines and can extend continuously around the inner circumference of the hub at the central portion thereof.

According to another aspect of the invention, a retaining member for locking a hollow hub of a cartridge to a mandrel assembly includes first and second elastic locking members each having a raised portion, the raised portion of the first locking member engaging the mandrel assembly and the raised portion of the second locking member preferably being disposed approximately halfway between ends of the mandrel assembly and engaging the detent on the internal surface of the hub. During assembly, sliding the retaining member onto the mandrel assembly causes the first locking member to be urged radially outwardly and then to move radially inwardly to cause the raised portion of the first locking member to enter an opening in the mandrel assembly. During cartridge replacement, sliding the hub onto the retaining member preferably causes the second locking member to be urged radially inwardly and then to move radially outwardly to cause the raised portion of the second locking member to enter the detent of the hub.

The retaining member preferably includes a tapered end, and the first and second locking members are also preferably tapered. A gap preferably extends between the first and second locking members so as to render them more flexible.

The retaining member preferably includes a pair of diametrically opposed first locking members and a pair of diametrically opposed second locking members, the pair of second locking members alternating with the pair of first locking members.

According to another aspect of the invention, a latch mechanism for retaining a cartridge of material, preferably printing ribbon wound between two hubs of the cartridge, to a drive mechanism, preferably including first and second mandrel assemblies, includes a detent located between opposite ends of the first and second hubs and a locking mechanism on at least one of the first and second mandrel assemblies for resiliently engaging the detent formed in the first and second hubs.

The detents in the hubs are preferably located approximately halfway between opposite ends of the hubs. The first and second mandrel assemblies preferably each include an end cap, the end cap preferably including the locking mechanism and also including a raised portion for locking the end cap to the mandrel assembly. The latch mechanism also preferably includes a driver for engaging the hubs, so that rotation of the driver rotates the hubs. Each mandrel assembly preferably includes a biasing member for biasing the locking member and the driver in opposite directions. The first and second mandrel assemblies are preferably part of a printing device, such as a copier.

BRIEF DESCRIPTION OF THE DRAWINGS

Preferred embodiments are described with reference to the drawings, in which like reference numerals denote like elements throughout the Figures, and in which.

DETAILED DESCRIPTION OF PREFERRED EMBODIMENTS

Figure 1:
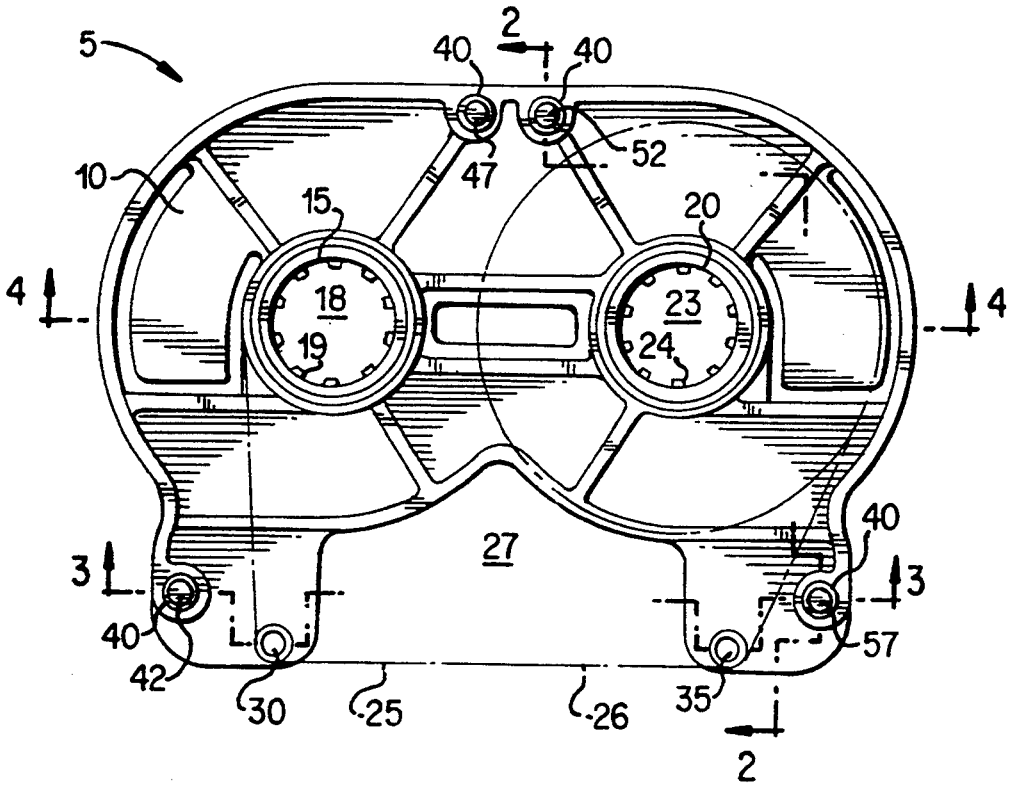
FIG. 1 is a front view of the inside of a ribbon cartridge casing component according to an embodiment of the invention.
Figure 2:
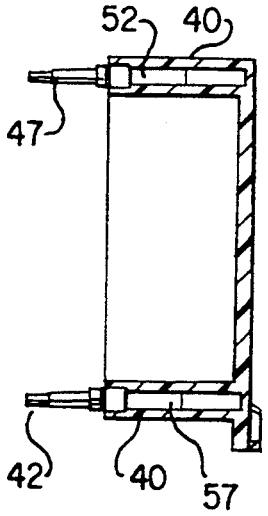
FIG. 2 is a cross-sectional view taken on line 2—2 of FIG. 1.
Figure 3:
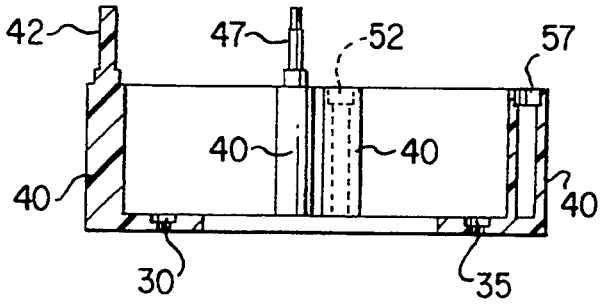
FIG. 3 is a cross-sectional view taken on line 3—3 of FIG. 1.
Figure 4:
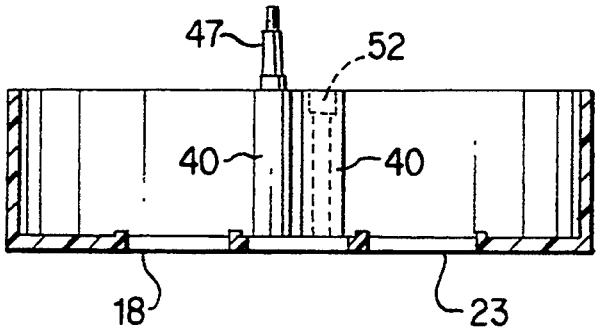
FIG. 4 is a cross-sectional view taken on line 4—4 of FIG. 1.

The disclosed ribbon cartridge, hub and latch mechanism can be used in a thermal portable copier, such as disclosed in the related applications incorporated by reference above, or as disclosed, for example, in U.S. Pat. No. 5,187,588 to Denis J. Stemmle, the disclosure of which is incorporated herein by reference. With such portable copiers, the cartridge includes a ribbon comprised of a substrate having an ink coated on one surface thereof. The ink is transferred to a copy sheet when it is heated by resistive heater elements of a thermal printhead included in the copier. The present invention is not limited to cartridges using thermally sensitive ink ribbons. Pressure sensitive ink ribbons, usable with impact-type printheads, also may be used. The disclosed invention also is applicable to ribbon cartridges for printing devices other than portable copiers, such as typewriters, printers, facsimile machines, etc. The present invention also is applicable to cartridges that contain materials other than ink ribbons, such as cartridges that contain elongate lengths of material wound between two hubs, such as audio/visual tape cassettes. Thus, while preferred embodiments of the invention will be described, the invention is not limited to these embodiments.

FIGS. 1–5 illustrate one ribbon cartridge embodiment according to the invention. Cartridge 5 includes two attached, preferably identical casing components 10, 10' shown in FIG. 5. Casing component 10, shown in FIGS. 1–4, includes two hollow hubs 15, 20, respectively disposed in casing component apertures 18, 23. Preferably, hubs 15, 20 include internal splines 19, 24 for engagement by a drive structure of the printing device (not shown). One of hubs 15, 20 is a supply hub, and the other is a take-up hub that receives ribbon 25 from the supply hub. When a multi-pass ribbon is used, which can be wound/unwound multiple times back-and-forth between hubs 15, 20, both hubs alternately function as supply and take-up hubs. However, in order to simplify the description, one hub will be referred to as a take-up hub, and the other as a supply hub.

Figure 25:
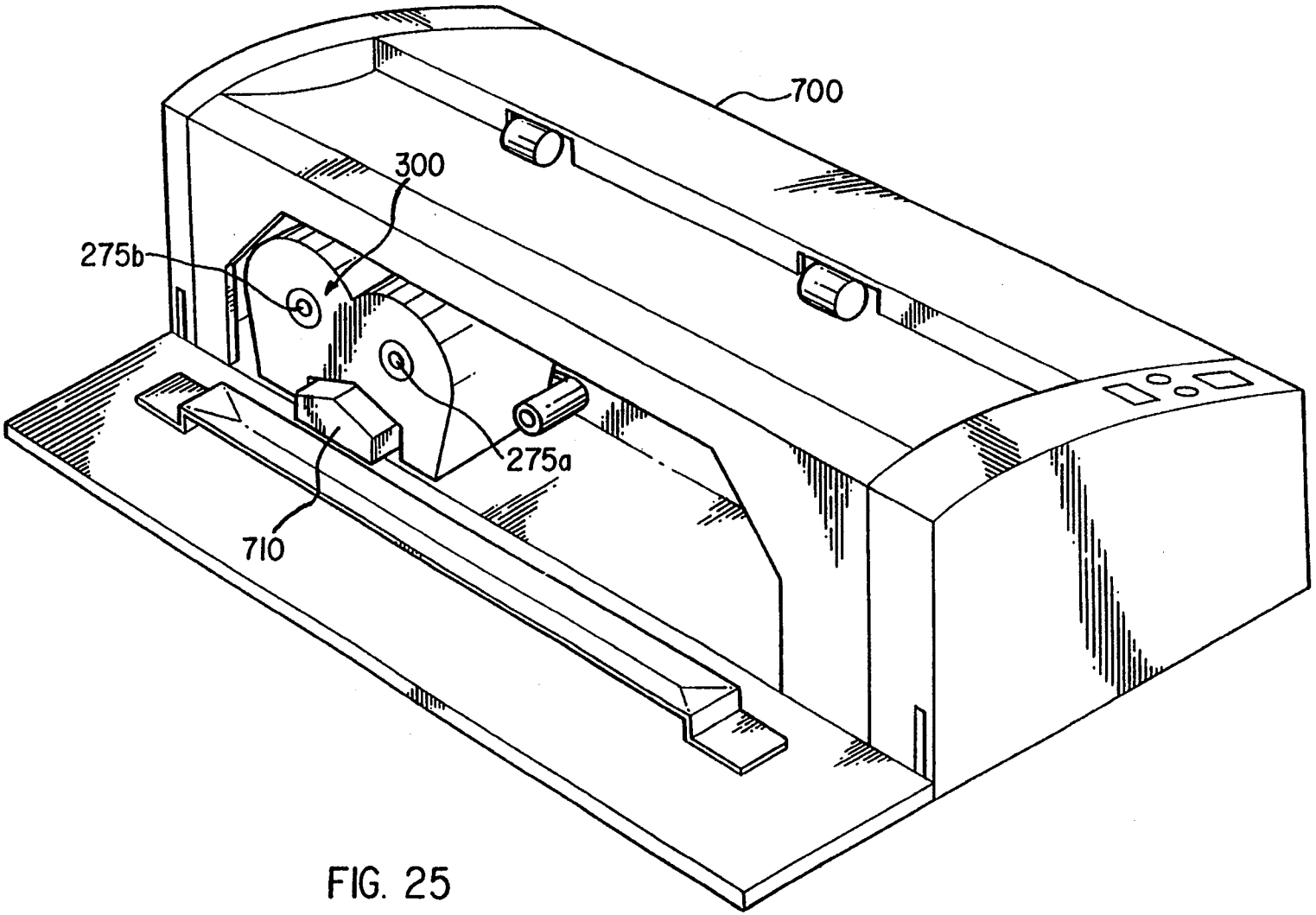
FIG. 25 is a perspective view of a portable copier that can use a cartridge having the hubs of the present invention.

Ribbon 25, preferably including one inked side 26, is supported on and wrapped around hubs 15, 20 and moves from the supply hub toward the take-up hub as a drive mechanism (not illustrated) rotates one or both of the hubs. Recess 27 of cartridge 5 can accommodate a printhead, such as a portable copier thermal transfer printhead 710 (see FIG. 25) that transfers ink on one surface of ribbon 25 to a copy sheet in a portable copier 700.

Casing component 10 preferably includes two extended members or connecting pins 42, 47 supported on casing wall 40. In a preferred embodiment, connecting pins 42, 47 are one-piece with casing wall 40, which is one-piece with casing 10. Alternatively, pins 42, 47 can be separate pieces, mounted within wall 40. Casing component 10 also includes receiving cavities or holes 52, 57 within wall 40 for receiving connecting pins of complimentary casing component 10', shown in FIG. 5.

Figure 5:
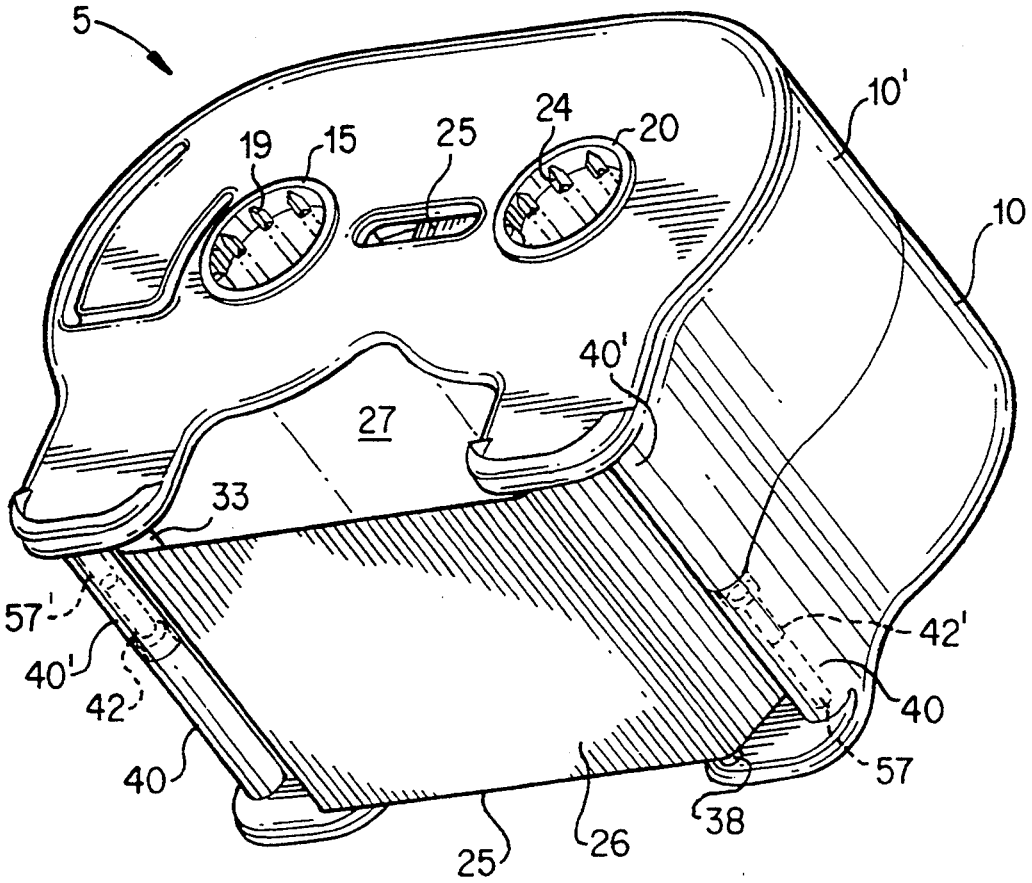
FIG. 5 is a perspective view of a ribbon cartridge including two casing components, two splined hubs, two guide pins, and the ribbon.

Casing component 10 also includes apertures 30, 35 for receiving a ribbon guide member that preferably includes two cylindrical ribbon guide pins 33, 38 (see FIG. 5). Ribbon guide pins 33, 38 preferably are fixed within apertures 30, 35. Alternatively, ribbon guide pins 33, 38 may include projections at the ends thereof that are received within apertures 30, 35, allowing the ribbon guide pins to rotate in the apertures as ribbon 25 moves across them. Pins 33, 38 guide ribbon 25 to a desired position under the printhead accommodated within recess 27.

Preferably, ribbon guide pins 33, 38 are formed of metal and are separate from casing components 10, 10', which are preferably formed of plastic. In an alternative embodiment, however, one or both of ribbon guide pins 33, 38 are formed as one piece with one of casing components 10, 10', and therefore also are plastic.

As shown in FIG. 5, ribbon cartridge 5 includes casing component 10 and attached, preferably identical casing component 10'. Connecting pin 42, mounted on wall 40 of casing component 10, is received within receiving hole 57' in wall 40' of casing component 10'. Likewise, connecting pin 42', mounted on wall 40' of casing component 10', is received within receiving hole 57 of wall 40. Ribbon guide pins 33, 38 extend between casing components 10, 10' and may either rotate (if they are discrete from both casing components 10, 10') or remain stationary (if they are one-piece with one of components 10, 10' or are discrete elements fixedly attached to components 10, 10') as ribbon 25 moves across them.

Ribbon cartridge 5 includes a minimal number of moving parts, unlike prior art cartridges. When ribbon guide pins 33, 38, being one-piece with casing components 10, 10' or being discrete parts, remain stationary as ribbon 25 moves across them, cartridge 5 includes only three moving parts: supply and take-up hubs 15, 20, and ribbon 25. When ribbon guide pins 33, 38 rotate as ribbon 25 moves across them, cartridge 5 includes only five moving parts: hubs 15, 20, ribbon 25, and guide pins 33, 38. When ribbon guide pins 33, 38 are formed as one piece with casing components 10, 10', cartridge 5 includes five total parts: hubs 15, 20, ribbon 25, and casing components 10, 10'. When ribbon guide pins 33, 38 are discrete from casing components 10, 10', cartridge 5 includes seven total parts: hubs 15, 20, ribbon 25, casing components 10, 10', and ribbon guide pins 33, 38.

By reducing the number of moving parts and the number of total parts, the ribbon cartridge according to the invention minimizes production costs and the likelihood of ribbon cartridge failure. This is in contrast to prior art cartridges, which, with their 15–20 total parts, have higher failure rates and production costs because of their greater complexity. The ribbon cartridge according to the invention also reduces tooling costs. The seven-part cartridge requires only three tools and the five-part cartridge requires only two tools for cartridge fabrication. Other benefits include lower parts inventory and associated costs and reduced assembly time. Further, because the two halves of the cartridge are easily pressed together, no additional fasteners are required for assembly. Still further, because inked side 26 of ribbon 25 does not contact any non-ribbon element of the cartridge, ink abrasion or removal on side 26 is avoided. Print quality defects and ribbon cartridge contamination also are avoided thereby.

Figure 6:
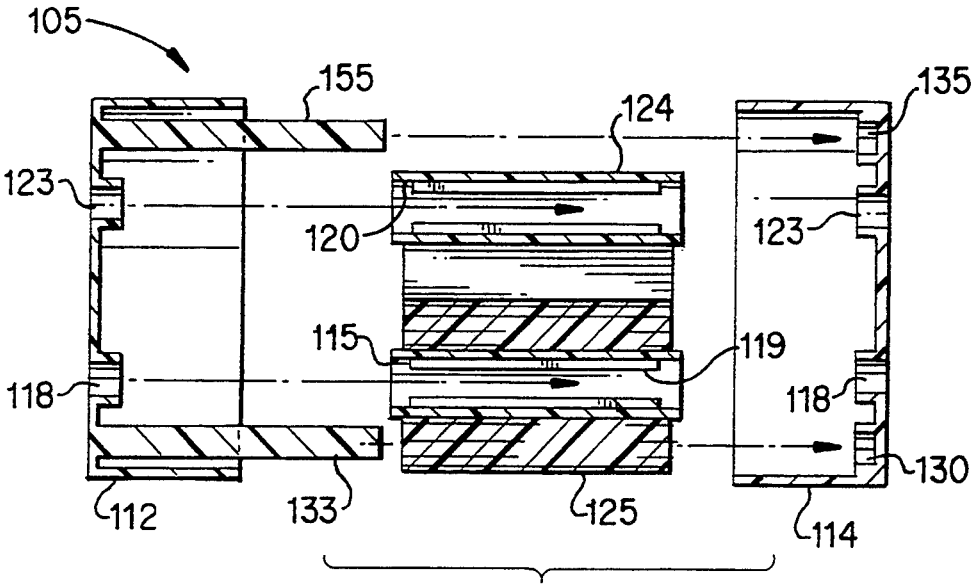
FIG. 6 is an exploded view of an alternate, five-piece ribbon cartridge according to the invention.
Figure 7:
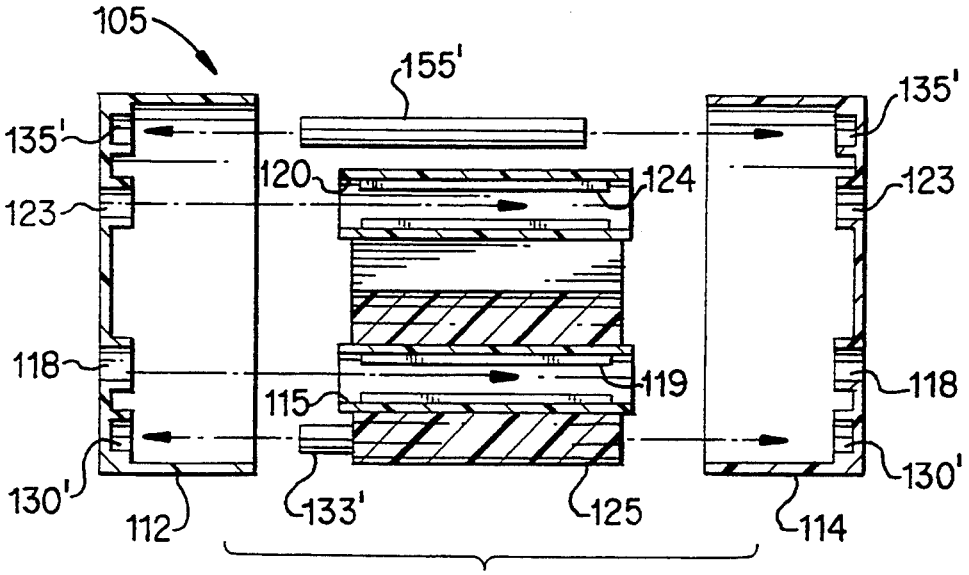
FIG. 7 is an exploded view of another ribbon cartridge embodiment, having seven pieces, according to the invention.
Figure 8:
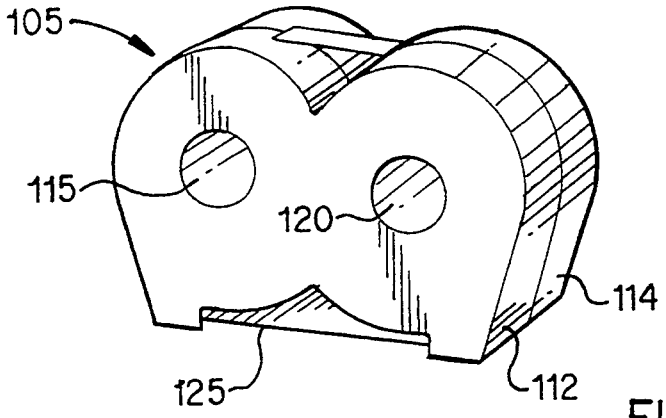
FIG. 8 is a perspective view of the ribbon cartridge shown in FIG. 6 or FIG. 7.

FIGS. 6–8 illustrate other embodiments of ribbon cartridges according to the invention. Ribbon cartridge 105 includes two casing components 112, 114, hubs 115, 120 with internal splines 119, 124, and ribbon 125 supported by and wound around the hubs. Hubs 115, 120 are supported on hollow protrusions 118, 123 formed in casing components 112, 114. In the FIG. 6 embodiment, ribbon guide pins 133, 155 are one-piece with casing component 112 and extend into recesses 130, 135 of casing component 114. Alternatively, guide pin or extended member 133 can extend from casing component 112, guide pin or extended member 155 can extend from casing component 114, recess or cavity 130 can be provided in casing component 114, and recess or cavity 135 can be provided in casing component 112. Casing components 112 and 114 thus can be identical, reducing tooling and inventory costs. In the FIG. 7 embodiment, ribbon guide pins 133', 155' are separate from casing components 112, 114 and fit into recesses 130', 135' therein. In one embodiment, ribbon guide pins 133', 155' remain stationary as ribbon 125 moves across them. Alternatively, ribbon guide pins 133', 155' can rotate within apertures 130', 135'.

Providing ribbon guide pins 133, 155 that are one-piece with casing component 112, as in the FIG. 6 embodiment, simplifies assembly by eliminating the guide pins as two extra pieces of the ribbon cartridge. Alternatively, providing separate ribbon guide pins 133', 155' reduces the cost of molding casing component 112.

In the FIG. 7 embodiment, ribbon cartridge 105 includes seven total pieces: the two casing components, the supply and take-up hubs, the ribbon, and the two ribbon guide pins. In the FIG. 6 embodiment, ribbon cartridge 105 includes five total pieces: the two casing components (including at least one ribbon guide pin integrally formed with at least one of the casing components), the supply and take-up hubs, and the ribbon. If the ribbon guide pins are formed as one piece with the casing, or are separate pieces that are fixedly attached to the casing, the only movable elements of the ribbon cartridge are the ribbon and hubs. Alternatively, if the ribbon guide pins are separate from and rotatably mounted to the casing, the only movable elements of the ribbon cartridge are the ribbon, hubs, and ribbon guide pins.

In all of the above embodiments, the ribbon cartridge according to the invention obtains significant advantages over the more complex, 15–20 piece ribbon cartridges of the prior art.

Figure 9:
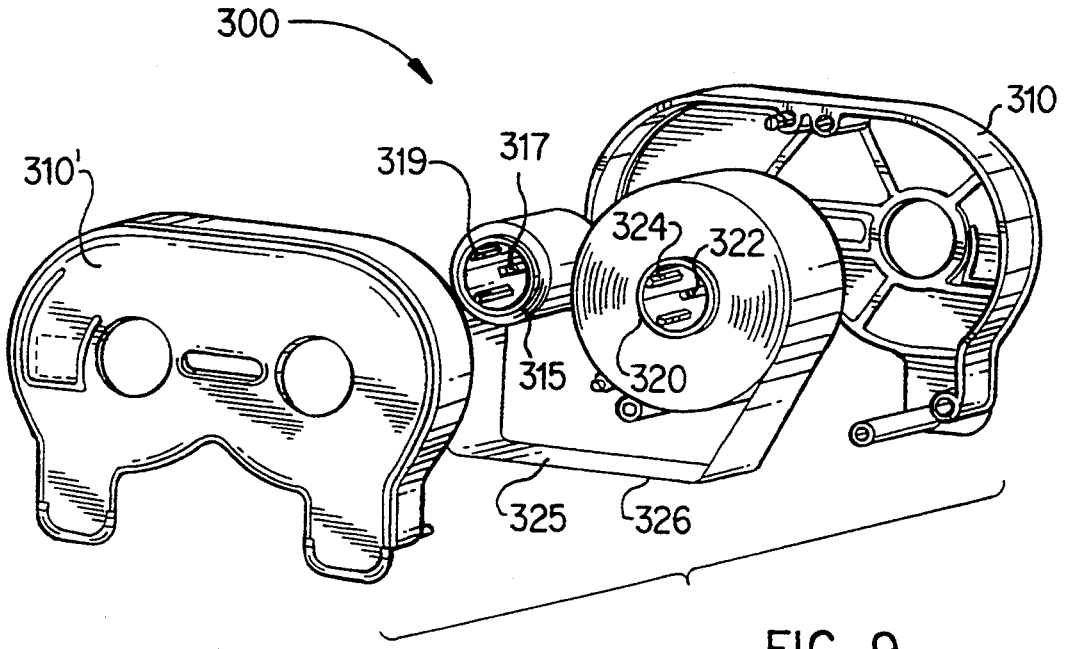
FIG. 9 is an exploded view of a ribbon cartridge according to another embodiment of the invention.

FIG. 9 shows another ribbon cartridge embodiment according to the invention, in which cartridge 300 includes casing components 310, 310', supply hub 315 and take-up hub 320. Ribbon 325, preferably having heat-sensitive, transferrable ink on one surface 326, is fed between supply hub 315 and take-up hub 320.

Ribbon 325 preferably is a multi-pass ribbon, which can be wound/unwound multiple times back-and-forth between hubs 315, 320. When ribbon 325 is expended on a first pass, an operator removes cartridge 300, turns it over, and re-inserts it back into the printing device for a second pass. Both hubs, therefore, can alternately function as supply and take-up hubs. To simplify the description, however, hub 315 will be called a supply hub and hub 320 a take-up hub.

Hubs 315 and 320 include splines 317, 319 and 322, 324, respectively. Alternatively, when ribbon 325 is intended for use as a single-pass ribbon, hubs 315, 320 need include only splines 317, 322, respectively. Hubs 315, 320 are further described with reference to FIGS. 11–13. Although FIGS. 11–13 show supply hub 315 and splines 317, 319, take-up hub 320 and its splines 322, 324 are identical to hub 315 and splines 317, 319 and will not be described independently.

Hub 315 preferably is hollow, tubular and cylindrical, although hub 315 can have other shapes without departing from the invention. Hub 315 includes outer surface 314, inner surface 316 disposed radially inwardly from outer surface 314, first and second opposite ends 311, 318, central portion 332 disposed between ends 311, 318, first set 312 of splines 317 and second set 313 of splines 319. Although first and second sets 312, 313 each preferably include a plurality of splines, each set 312, 313 can also include a single spline. Further, as described above, when ribbon 325 is intended for use as a single-pass ribbon, hub 315 need include only first set 312 of splines 317.

Splines 317, 319 are preferably linearly elongated in a longitudinal direction of hub 315. Alternatively, splines 317, 319 may assume other shapes, such as bead-shaped or ball-shaped protrusions. Splines 317, 319 are preferably evenly distributed around the circumference of hub 315.

Figure 11:
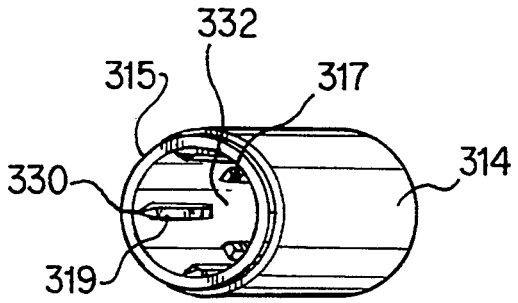
FIG. 11 is a perspective view of a split-spline hub according to the invention.
Figure 12:
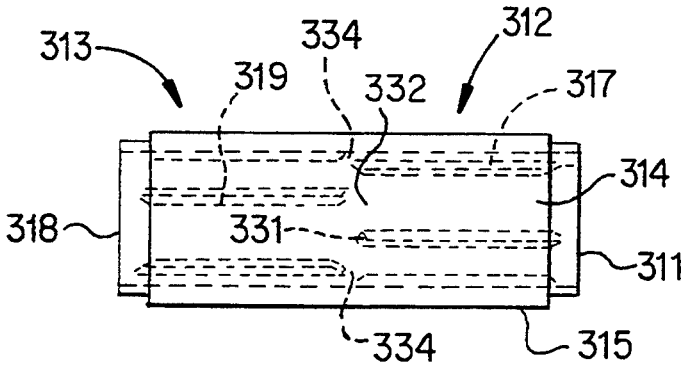
FIG. 12 is a side view of the FIG. 11 hub.
Figure 13:
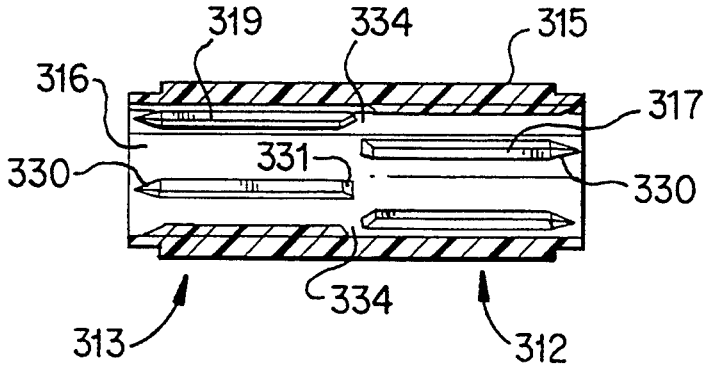
FIG. 13 is a cross-sectional side view of the FIG. 11 hub.

As shown in FIGS. 11–13, first set 312 of splines 317 extends from a position near first end 311 of hub 315 toward central portion 332 of hub 315. Similarly, second set 312 of splines 319 extends from near second end 318 of hub 315 toward central portion 332. Both sets 312, 313 terminate at central portion 332 and stop short of a midpoint of inner surface 316 as shown in FIGS. 12 and 13.

Splines 317 preferably include tapered ends 330 near first end 311 of hub 315 and tapered ends 331 near central portion 332. Similarly, splines 319 include tapered ends 330 near second end 318 of hub 315 and tapered ends 331 near central portion 332.

First set 312 of splines 317 is longitudinally offset from second set 313 of splines 319 (that is, ends 331 of splines 317 and 319 are longitudinally spaced from each other ). Detent 334, extending around an inner circumference of inner surface 316 at central portion 332, preferably is formed by the inner ends of splines 317, 319 and preferably is positioned approximately midway between ends 311, 318 of hub 315. Alternatively, detent 334 can be positioned at other positions inboard of ends 311, 318.

The longitudinal offset between the first and second sets 312, 313 enables hub 315 to be molded with a simple, pull-apart mold. Additional slides on the mold, which increase tooling costs, reduce tool life and increase cycle time, all of which increase part cost, are not required.

Splines 317 of first set 312 are preferably angularly offset with respect to splines 319 of second set 313, in a circumferential direction on inner surface 316. Splines 317, 319 of each spline set 312, 313 are angularly offset far enough apart to allow hubs 315, 320 to be loaded onto a straight-splined shaft, that is, a shaft having straight splines without any longitudinal offset. Detent 334 does not interfere with such loading. Ribbon cartridge 300 can be loaded, therefore, onto conventional devices, such as printing devices or ribbon winding machines, as easily as if its hubs each had only a single set of straight splines.

Figure 10:
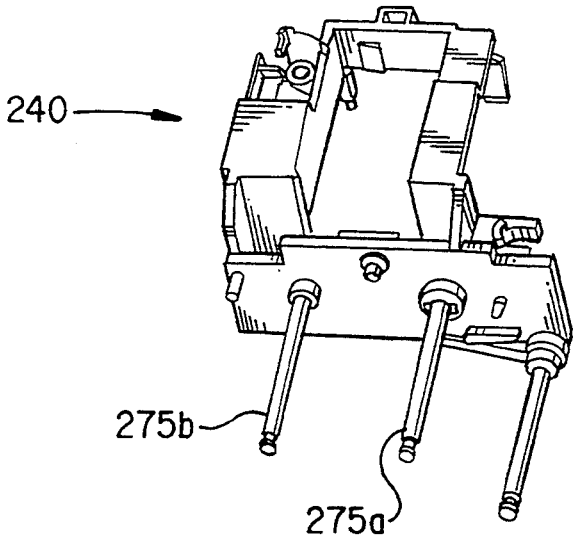
FIG. 10 is a perspective view of a carriage assembly according to the invention.

As shown in FIG. 10, scan carriage 240 is provided for supporting ribbon cartridge 300 for scanning movement across a copy sheet, in a preferred embodiment, for example, in a portable copier 700. Mandrels 275*a*, 275*b* of scan carriage 240, preferably non-rotating fixed support pins forming at least part of a drive mechanism, extend through and support hubs 315, 320 of cartridge 300, as described below with reference to FIGS. 14–16.

Figure 14:
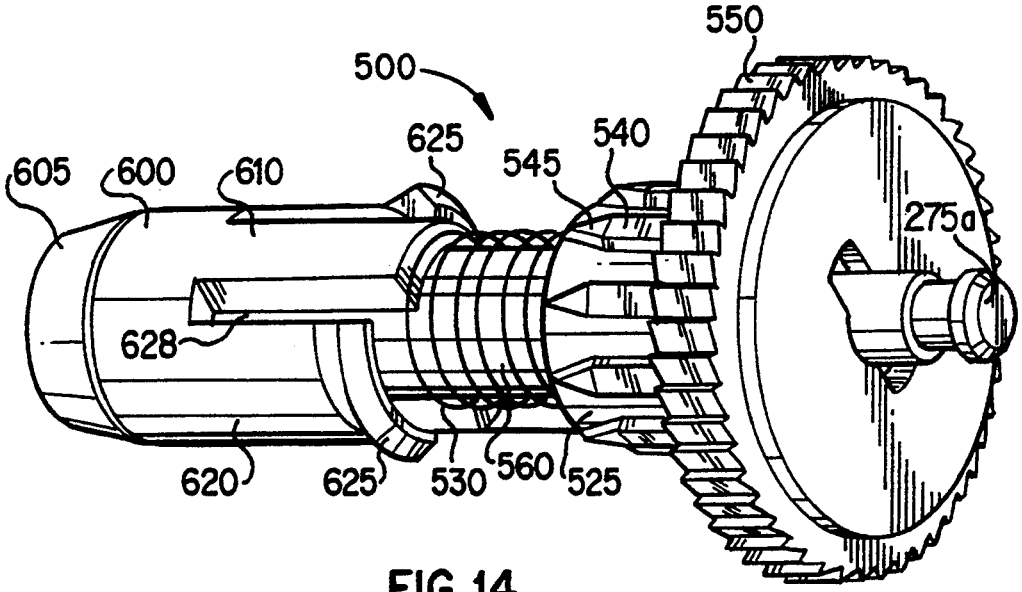
FIG. 14 is a perspective view of a retaining member and mandrel assembly according to the invention.
Figure 15:
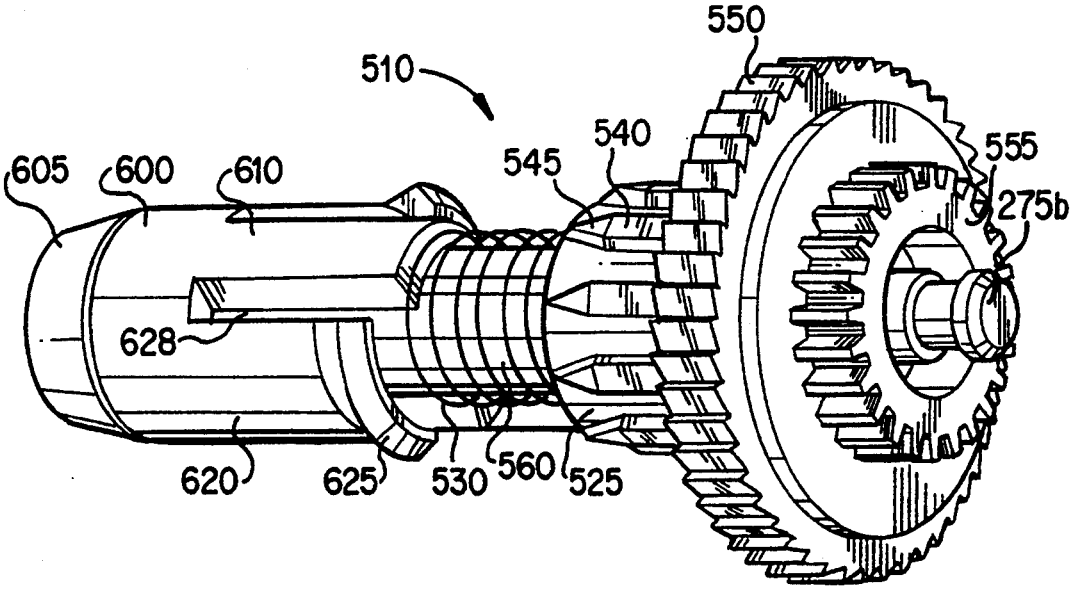
FIG. 15 is a perspective view of a retaining member and alternate mandrel assembly according to the invention.
Figure 16:
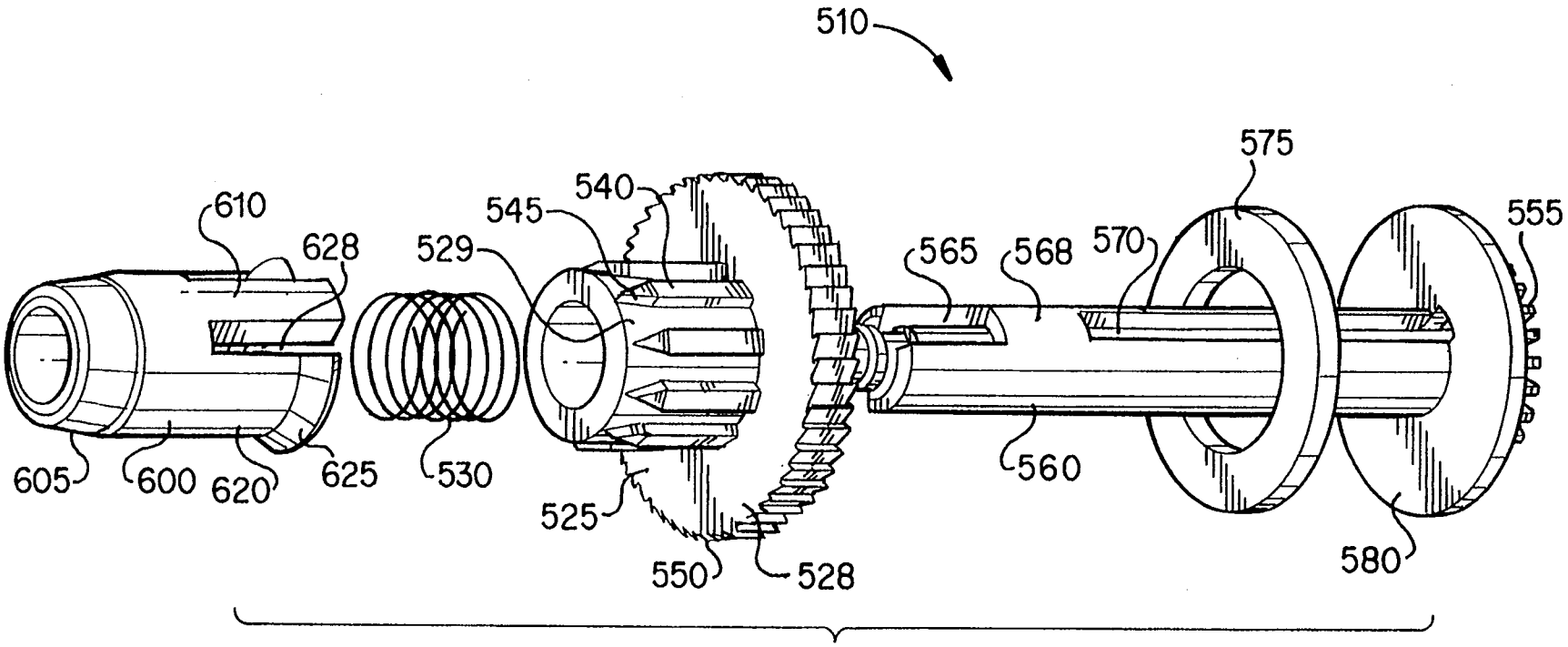
FIG. 16 is an exploded view of the FIG. 15 retaining member and mandrel assembly.

FIGS. 14–16 show mandrel assemblies 500, 510 disposed on mandrels 275*a*, 275*b*, respectively, of scan carriage 240. FIG. 14 shows ribbon supply mandrel assembly 500, which supports supply hub 315, and FIGS. 15–16 show ribbon take-up mandrel assembly 510, which supports ribbon take-up hub 320. (Hubs 315, 320 may alternatively function as supply and take-up hubs, however, depending on which side of ribbon cartridge 300 is facing scan carriage 240, as described above.) Take-up mandrel assembly 510 is nearly identical to supply mandrel assembly 500, but additionally includes drive gear 555. To simplify the description, therefore, only take-up mandrel assembly 510 will be described.

Mandrel assembly 510 includes spindle 560, which directly receives mandrel 275*b* of scan carriage 240 (FIG. 10). Spindle 560 includes disk portion 580 rigidly affixed thereto, and supports driver 525, which includes first and second sections 528, 529. First section 528 includes gear teeth 550, for engagement with a ratchet mechanism (not shown), which prevents driver 525 from moving in a direction opposite from the drive direction. Second section 529 includes engagement members 540, preferably splines, for engaging splines 322 or 324 of take-up hub 320. To facilitate insertion of take-up hub 320 onto mandrel assembly 510, engagement members 540 include tapered ends 545.

Mandrel assembly 510 includes retaining member 600, preferably in the form of an end cap, which is fixed to the end of spindle 560 and engages take-up hub 320 of cartridge 300, as described below. Biasing member 530, preferably a spring, is disposed between retaining member 600 and driver 525 and urges driver 525 toward disk portion 580. Mandrel assembly 510 also includes clutch disk 575, preferably made from felt. Clutch disk 575 is sandwiched between driver 525 and disk portion 580 so that when gear 555 is driven, clutch disk 575 transmits force to driver 525, while permitting some slippage between gear 555 and driver 525. Accordingly, there can be some slippage between retaining member 600 and the hub, but not between the hub and driver 525. Retaining member 600 secures biasing member 530, driver 525 and clutch disk 575 on spindle 560.

Figure 21:
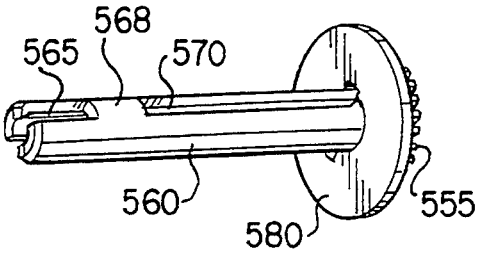
FIG. 21 is a perspective view of a mandrel assembly spindle according to the invention.
Figure 22:
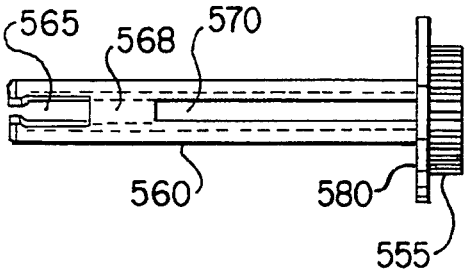
FIG. 22 is a top view of the FIG. 21 spindle.

Spindle 560, best shown in FIGS. 16, 21 and 22, includes first and second openings 565, 570, preferably longitudinally extending grooves, which extend through spindle 560 and are separated by spindle portion 568. Spindle 560 of take-up mandrel assembly 510 also includes drive gear 555, disposed on disk portion 580 at an end of spindle 560 opposite groove 565. As described above, although supply and take-up mandrel assemblies 500, 510 are identical in other respects, only spindle 560 of take-up mandrel assembly 510 includes drive gear 555.

As best shown in FIGS. 17–20, retaining member 600 of mandrel assemblies 500, 510 includes a body member having first and second pairs of diametrically opposed elastic locking members 610, 620, alternatingly spaced from each other and separated by gaps 628. Locking members 610 each include raised portion 615, extending radially inwardly, and locking members 620 each include raised portion 625, extending radially outwardly. Locking members 620 form a locking mechanism for securing one of hubs 315, 320 on retaining member 600, as described below. Retaining member 600 also includes tapered end 605, preferably in the form of a nose cone, to facilitate insertion of hubs 315, 320 of cartridge 300 onto mandrel assemblies 500, 510.

Figure 20:
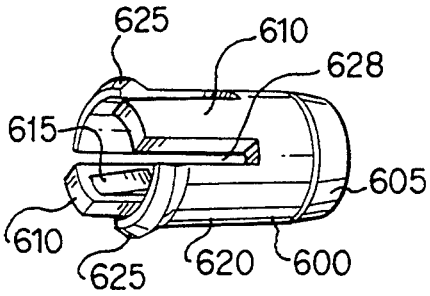
FIG. 20 is a perspective view of the FIG. 17 retaining member.

To secure retaining member 600 to spindle 560, retaining member 600 is first aligned with spindle 560 so that raised portions 615 of locking members 610 enter groove 565. As retaining member 600 is pushed along spindle 560 toward groove 570, raised portions 615 of first locking members 610 engage spindle portion 568, which is disposed between grooves 565, 570. Raised portions 615 include a ramped surface, as best shown in FIG. 20, and, by engaging spindle portions 568 as retaining member 600 slides further along spindle 560, cause locking members 610 to move radially outwardly. As retaining member 600 slides still further along spindle 560, raised portions 615 snap into grooves 570 and are locked behind spindle portion 568, thereby locking retaining member 600 to spindle 560.

Once retaining members 600 are secured to spindles 560 of mandrel assemblies 500, 510, hubs 315, 320 of ribbon cartridge 300 can be secured to retaining members 600 in the following manner. Hubs 315, 320 of cartridge 300 are aligned with and pushed onto retaining members 600. The tapered nose cone 605 of retaining members 600 makes alignment of the hubs to the spindle assemblies easy. As hubs 315, 320 slide onto retaining member 600, raised portions 625 of elastic locking members 620 engage one of spline sets 312, 313 of supply hub 315, and one of the corresponding spline sets of take-up hub 320. The spline sets that are engaged depend on which side of cartridge 300 is facing mandrel assemblies 500, 510. Tapered end 605 of each retaining member 600, and tapered ends 330 of splines 317, 322 (or 319, 324), facilitate the sliding movement of hubs 315, 320 along retaining members 600.

Figure 17:
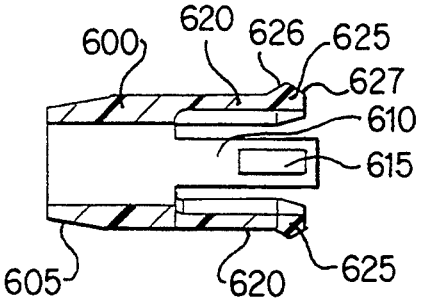
FIG. 17 is a cross-sectional view of a retaining member according to the invention.
Figure 18:
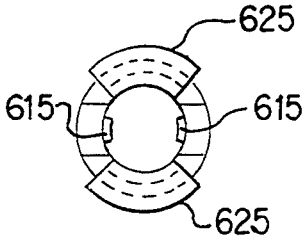
FIG. 18 is an end view of the FIG. 17 retaining member.
Figure 19:
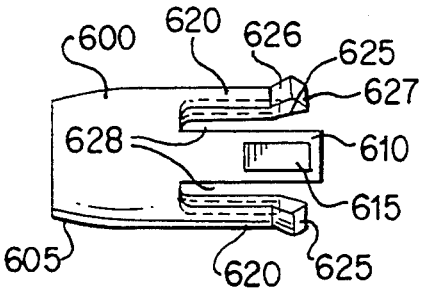
FIG. 19 is a side view of the FIG. 17 retaining member.

Raised portions 625 each include first and second ramped surfaces 626, 627, shown in FIGS. 17 and 19. As hub 315 slides further onto retaining member 600 of mandrel assembly 500, first ramped surface 626 of each raised portion 625 engages tapered ends 330 of splines 317 (or 319), urging locking members 620 radially inwardly. (Similarly, splines 322 (or 324) of hub 320 urge locking members 620 of mandrel assembly 510 radially inwardly.)

As ribbon cartridge 300 continues to slide along retaining member 600, second ramped surface 627 of each raised portion 625 engages and slides along tapered ends 331 of splines 317, 322 (or 319, 324). Locking members 620 thereby move radially inwardly until raised portions 625 are moved past spline ends 331 into central area 334 of at least one of hubs 315, 320 (and, when hubs 315, 320 include two sets of splines, as illustrated, into detent 334). Hubs 315, 320 thereby become locked onto retaining members 600, and, consequently, cartridge 300 is locked onto mandrel assemblies 500, 510. When locked in position, splines 540 of driver 525 are located between and engaged with the splines on the hubs so that drivers 525 and hubs 315, 320 move in unison. Ramped surfaces 627 and tapered ends 331 also facilitate easy removal of cartridge 300 from mandrel assemblies 500, 510.

Cartridge 300 slides preferably approximately halfway over mandrel assemblies 500, 510 before encountering the biasing force of locking members 620. That is, when raised portions 625 contact hub splines 317, 319, 322 or 324, the nose cone 605 of retaining member 600 is positioned approximately halfway between the ends of each hub 315, 320. By the time an operator feels this force, ribbon cartridge 300 is already well-positioned and aligned relative to mandrel assemblies 500, 510. Then, pushing cartridge 300 slightly harder causes locking member 620 to move radially inwardly, and the hubs then continue to slide over retaining member 600 until raised portions 625 of retaining member 600 reach spline ends 331 and move radially outwardly into detent 334, thereby securing cartridge 300 into place on carriage 240. To remove cartridge 300 from carriage 240, the operator simply pulls cartridge 300 off carriage 240. Together, detent 334 of hubs 315, 320 and the locking mechanism of locking members 620 on retaining member 600 form a latch mechanism that releasably secures hubs 315, 320 of cartridge 300 to mandrel assemblies 500, 510.

Using two spline sets 312, 313 provides effective internal support across the entire length of mandrel assemblies 500, 510. This also enables the cartridge to function as a multi-pass cartridge as detailed above. Retaining member 600 still effectively latches cartridge 300 when only one of the sets 312, 313 of splines is used. A single set of splines extending from near one end of each hub to approximately a central portion of each hub can be used when single-pass ribbons are used. Providing only one set of splines, however, may cause hubs 315, 320 to wobble on mandrel assemblies 500, 510, potentially causing poor ribbon tracking that can wrinkle the ribbon and degrade the printed image. However, additional structure can be provided on the non-spline portion of the hub, or it can be made with a smaller diameter to prevent wobble. Additionally, when only a single set of splines is provided near a first end of each hub, the opposite end of the hub can be closed (instead of being open as shown in the drawings).

Figure 23:
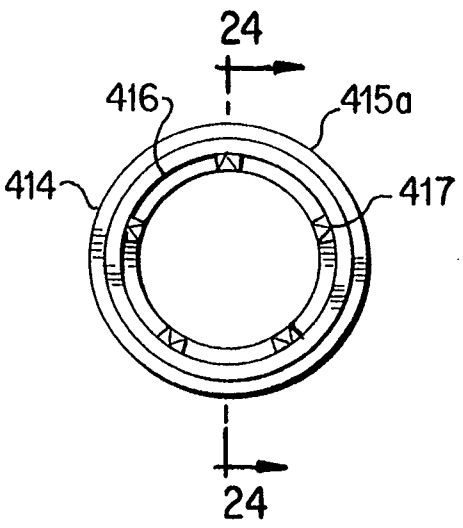
FIG. 23 is an end view of an alternate hub embodiment.
Figure 24:
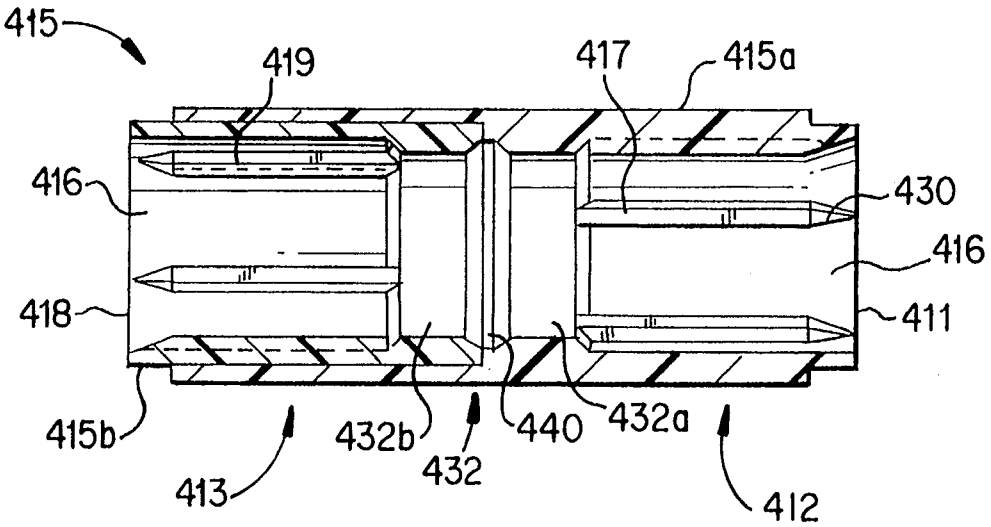
FIG. 24 is a cross-sectional view along line 24—24 of FIG. 23.

FIGS. 23–24 illustrate an alternate hub embodiment according to the invention. Hub 415 comprises two hub pieces **415*a*, 415*b*, piece 415*b* being slid or pressed into piece 415*a*. Continuous detent 440 is formed at the juncture of pieces 415*a*, 415*b* and is positioned approximately midway between ends 411, 418 of hub 415. Alternatively, the detent can be positioned at other positions inboard of ends 411, 418**.

Hub 415 includes outer surface 414, inner surface 416 disposed radially inwardly from outer surface 414, first and second opposite ends 411, 418, central portion 432 disposed between ends 411, 418, first set 412 of splines 417 and second set 413 of splines 419. Central portion 432 includes two central sub-portions **432*a*, 432*b*, which preferably have a raised surface compared to inner surface 416 at ends 411, 418 of hub 415. Sub-portions 432*a*, 432*b* of portion 432 are preferably at the same level as the radially innermost surface of splines 417, 419**.

Although first and second sets 412, 413 each preferably include a plurality of splines, each set 412, 413 can also include a single spline. Further, when the ribbon wrapped around hub 415 is intended for use as a single-pass ribbon, hub 415 need include only one of sets 412, 413 of splines.

First set 412 of splines 417 extends from a position near first end 411 of hub 415 toward central portion 432 of hub 415. Similarly, second set 412 of splines 419 extends from near second end 418 of hub 415 toward central portion 432. Both sets 412, 413 terminate at central portion 432.

Splines 417 preferably include tapered ends 430 near first end 411 of hub 415. Similarly, splines 419 include tapered ends 430 near second end 418 of hub 415.

As described above, the split-spline hub and latch mechanism of the invention allows easier installation and removal of the ribbon cartridge, provides a robust design that is far less susceptible to damage than previous devices, simplifies manufacturing methods, lowers part costs, and is compatible with both single-pass and multi-pass ribbon types.

While the invention has been described with reference to specific embodiments, the description is illustrative and is not to be construed as limiting the scope of the invention. For example, split-spline hubs according to the invention can be used to support materials other than ribbon and need not be incorporated in a printing device. According to the invention, a wide variety of hubs can be secured to a wide variety of drive mechanisms, not just mandrel assemblies of printing devices. Further, only one mandrel assembly and only one hub having internal splines can be used to lock the ribbon cartridge into position, that is, the other of the hubs need not include splines and/or a detent. Various other modifications and changes may occur to those skilled in the art without departing from the spirit and scope of the invention as defined in the following claims.

What is claimed is:

1. A tubular, hollow hub for supporting a length of material wound around the hub, said hub comprising:

an outer surface for receiving the material;

an inner surface disposed radially inwardly from the outer surface;

first and second opposite ends;

at least one first spline on the inner surface and extending in a longitudinal direction of said hub from near said first end of said hub toward a central portion of said hub and terminating between a midpoint of said hub and said first end so that said at least one spline is spaced from said midpoint of said hub, said midpoint being located midway between said first and second opposite ends; and a detent located near said midpoint and having a detent surface between said first end and said midpoint closely adjacent to said midpoint and facing said second end.

2. The hub of claim 1, further comprising:

at least one second spline on the inner surface, extending in said longitudinal direction of said hub from near said second end of said hub toward said central portion of said hub and terminating spaced from said midpoint of said hub.

3. The hub of claim 2, wherein said at least one first spline includes a plurality of said first splines defining a first set of splines, said at least one second spline includes a plurality of said second splines defining a second set of splines, and each of said plurality of first splines is offset from each of said plurality of second splines.

4. The hub of claim 1, wherein an end of said at least one first spline spaced away from said first hub end defines said detent surface.

5. The hub of claim 1, wherein the detent is continuous.

6. The hub of claim 3, wherein the detent is formed by an end of each of said plurality of first and second splines.

7. The hub of claim 1, wherein said detent surface is discontinuous.

8. The hub of claim 1, wherein ends of said at least one first spline are tapered.

9. The hub of claim 1, wherein said at least one first spline includes a plurality of said first splines defining a first set of splines.

10. The hub of claim 1, wherein said at least one first spline is elongated in the longitudinal direction of said hub.

11. The hub of claim 1, wherein the hub is of one piece construction.

12. The hub of claim 1, wherein the hub is formed of two pieces.

13. The hub of claim 12, wherein one of the two hub pieces is slideably received within the other of the two hub pieces.

14. A ribbon cartridge for use with a printing device, said ribbon cartridge comprising:

a casing;

a first hollow hub rotatably mounted to said casing, said first hub including: an outer surface; an internal surface; first and second opposite ends; and at least one first spline on the internal surface and extending in a longitudinal direction of the first hub from near the first end of the first hub toward a central portion of said first hub and terminating between a midpoint of said hub and said first end so that said at least one spline is spaced from said midpoint of said hub, said midpoint being located midway between said first and second opposite ends; and a detent located near said midpoint and having a detent surface between said first end and said midpoint closely adjacent to said midpoint and facing said second end;

a second hollow hub rotatably mounted to said casing, said second hub including: an outer surface; an internal surface; first and second opposite ends; and at least one first spline on the internal surface and extending in a longitudinal direction of the second hub from near the first end of the second hub toward a central portion of said second hub and terminating between a midpoint of said hub and said first end so that said at least one spline is spaced from said midpoint of said hub, said midpoint being located midway between said first and second opposite ends; and a detent located near said midpoint and having a detent surface between said first end and said midpoint closely adjacent to said midpoint and facing said second end;

a transfer ribbon wound between and around the outer surfaces of said first and second hollow hubs, said transfer ribbon containing transferrable ink on one surface thereof.

15. The ribbon cartridge of claim 14, wherein said first and second hubs each include a plurality of said first splines and a plurality of second splines defining first and second sets of splines, said first sets of splines extending from near the first ends of the first and second hubs toward the central portions of the first and second hubs and terminating spaced from said midpoints of the first and second hubs, and said second sets of splines extending from near the second ends of the first and second hubs toward the central portions of the first and second hubs and terminating spaced from said midpoints of the first and second hubs between said midpoints and said second ends.

16. The ribbon cartridge of claim 15, wherein all of said first splines of said first set of splines on each of said first and second hubs is offset from all of said second splines of the second set of splines on each of said first and second hubs.

17. The ribbon cartridge of claim 14, wherein an end of the at least one first spline on each of said first and second hubs spaced away from said first end of said hubs defines the detent surface on each of said first and second hubs.

18. The ribbon cartridge of claim 14, wherein ends of said at least one first spline on each of said hubs are tapered.

19. The ribbon cartridge of claim 14, wherein said transferable ink on said transfer ribbon is heat sensitive.

20. In combination, a tubular, hollow hub for supporting a length of material wound around said hub, and a retaining member for locking said hub to a mandrel assembly, said hub comprising:

an outer surface for receiving the material;

an inner surface disposed radially inwardly from the outer surface;

first and second opposite ends;

at least one first spline on the inner surface and extending in a longitudinal direction of said hub from near said first end of said hub toward a central portion of said hub and terminating between a midpoint of said hub and said first end so that said at least one spline is spaced from said midpoint of said hub, said midpoint being located midway between said first and second opposite ends; and a detent located near said midpoint and having a detent surface between said first end and said midpoint closely adjacent to said midpoint and facing said second end; and said retaining member comprising:

a body member at least partially slidable over the mandrel assembly;

a first elastic locking member having a first raised portion extending radially inwardly from said body member for engaging the mandrel assembly to fix the retaining member to the mandrel assembly; and a second elastic locking member having a second raised portion extending radially outward from said body member for engaging the detent surface of the hub to lock the hub to the mandrel assembly.

21. The combination of claim 20, wherein the first raised portion is provided on a resilient arm so that sliding the retaining member onto the mandrel assembly first causes the mandrel assembly to urge the first elastic locking member radially outwardly as the retaining member slides onto the mandrel assembly and then causes the first elastic locking member to move radially inwardly as the retaining member slides further onto the mandrel assembly, to cause the first raised portion to enter an opening in the mandrel assembly to lock the retaining member to the mandrel assembly.

22. The combination of claim 20, wherein the second raised portion is provided on a resilient arm so that sliding the hub onto the retaining member first causes the at least one first spline of the hub to urge the second elastic locking member radially inwardly as the hub slides onto the retaining member and then causes the second elastic locking member to move radially outwardly as the hub slides further onto the retaining member, to cause the second raised portion of the second elastic locking member to engage said detent surface to lock the hub to the retaining member.

23. The combination of claim 20, wherein said body member includes a tapered end for guiding the hub over the body member.

24. The combination of claim 20, wherein the first and second raised portions of the first and second elastic locking members are tapered, facilitating sliding of the hub onto the retaining member and facilitating sliding of the retaining member onto the mandrel assembly.

25. The combination of claim 20, wherein:

the first and second elastic locking members extend in a longitudinal direction from the body member; and a gap extends in the longitudinal direction between the first and second elastic locking members.

26. The combination of claim 20, wherein there are a pair of said first elastic locking members diametrically opposed relative to the body member, and a pair of second elastic locking members diametrically opposed relative to the body member and alternating with said pair of first elastic locking members around a circumference of said body member.

27. The combination of claim 20, wherein the second raised portion of the second elastic locking member is positioned approximately halfway between ends of the mandrel assembly.

28. In combination, a cartridge of ribbon wound between first and second hubs rotatably provided in the cartridge, and a latch mechanism for retaining the cartridge to a drive mechanism for driving the material between said two hubs, said drive mechanism including first and second mandrel assemblies for receiving said first and second hubs, said ribbon cartridge comprising:

a casing;

a first hollow hub rotatably mounted to said casing, said first hub including: an outer surface; an internal surface; first and second opposite ends; at least one first spline on the internal surface and extending in a longitudinal direction of the first hub from near the first end of the first hub toward a central portion of said first hub and terminating between a midpoint of said hub and said first end so that said at least one spline is spaced from said midpoint of said hub, said midpoint being located midway between said first and second opposite ends; and a detent located near said midpoint and having a detent surface between said first end and said midpoint closely adjacent to said midpoint and facing said second end;

a second hollow hub rotatably mounted to said casing, said second hub including: an outer surface; an internal surface; first and second opposite ends; at least one first spline on the internal surface and extending in a longitudinal direction of the second hub from near the first end of the second hub toward a central portion of said second hub and terminating between a midpoint of said hub and said first end so that said at least one spline is spaced from said midpoint of said hub, said midpoint being located midway between said first and second opposite ends; and a detent located near said midpoint and having a detent surface between said first end and said midpoint closely adjacent to said midpoint and facing said second end spaced from said midpoint of said hub, said midpoint being located midway between said first and second opposite ends; and a detent located near said midpoint and having a detent surface between said first end and said midpoint closely adjacent to said midpoint and facing said second end; and a transfer ribbon wound between and around the outer surfaces of said first and second hollow hubs, said transfer ribbon containing transferrable ink on one surface thereof; and said latch mechanism comprising:

a locking mechanism on at least one of said first and second mandrel assemblies for resiliently engaging the detent surface formed in one of said first and second hubs.

29. The combination of claim 28, wherein each of said first and second mandrel assemblies includes an end cap attached to a mandrel, said end cap including said locking mechanism and also including a raised portion for locking said end cap to said mandrel.

30. The combination of claim 29, wherein said end cap is tapered to guide said mandrel assembly into said hubs.

31. The combination of claim 28, wherein at least one of the mandrel assemblies includes a driver having engagement members for engaging the at least one spline of at least one of said first and second hubs so that rotation of the driver rotates the hubs.

32. The combination of claim 28, wherein at least one of the mandrel assemblies includes a driver having engagement members for engaging the at least one spline of at least one of said first and second hubs so that rotation of said at least one hub engaged with said engagement members rotates the at least one driver.

33. The latch mechanism of claim 28, wherein the rotational speed of at least one of the first and second hubs can be different than the rotational speed of the locking mechanism.

34. The combination of claim 31, wherein said at least one of said mandrel assemblies further includes a biasing member disposed between the locking mechanism and the driver, the biasing member biasing the locking mechanism and the driver in opposite directions.

35. The combination of claim 28, wherein said first and second mandrel assemblies are part of a printing device.

36. The combination of claim 35, wherein said printing device is a copier.

* * * * *